US009329569B2

(12) United States Patent
Tani et al.

(10) Patent No.: US 9,329,569 B2
(45) Date of Patent: May 3, 2016

(54) MANUFACTURING METHOD OF CARTRIDGE INCLUDING INFORMATION STORING ELEMENT, INFORMATION STORING ELEMENT EXCHANGING METHOD OF THE CARTRIDGE, THE CARTRIDGE AND IMAGE FORMING APPARATUS

(71) Applicant: CANON KABUSHIKI KAISHA, Tokyo (JP)

(72) Inventors: Sadaaki Tani, Kawasaki (JP); Tatsuya Kanno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/555,814

(22) Filed: Nov. 28, 2014

(65) Prior Publication Data

US 2015/0153706 A1 Jun. 4, 2015

(30) Foreign Application Priority Data

Nov. 29, 2013 (JP) ..... 2013-247319

(51) Int. Cl.
*G03G 15/00* (2006.01)
*G03G 21/18* (2006.01)
*G03G 21/16* (2006.01)

(52) U.S. Cl.
CPC ..... *G03G 21/18* (2013.01); *G03G 21/1652* (2013.01); *Y10T 29/49023* (2015.01)

(58) Field of Classification Search
CPC .. G03G 21/18; G03G 21/1652; G03G 21/181
USPC ..... 399/109, 12, 111; 439/73; 361/783
See application file for complete search history.

(56) References Cited

U.S. PATENT DOCUMENTS 5,779,488 A * 7/1998 Cluff ..... H05K 7/1023 439/73
5,936,849 A * 8/1999 Fetterman ..... G01R 1/0433 439/73
6,826,380 B2 11/2004 Karakama et al.
6,904,248 B2 * 6/2005 Daniels ..... G03G 21/181 399/109
8,238,787 B2 8/2012 Tani
8,526,851 B2 9/2013 Tani
2004/0170445 A1 * 9/2004 Moore ..... G03G 21/12 399/109
2005/0036801 A1 * 2/2005 Burchette ..... G03G 21/1875 399/109
2006/0285876 A1 * 12/2006 Karagiannis ..... G03G 21/181 399/109
2014/0219689 A1 8/2014 Horikawa et al.

FOREIGN PATENT DOCUMENTS

JP 2003-330335 A 11/2003
JP 2007-047397 A 2/2007

* cited by examiner

*Primary Examiner* — Susan Lee
(74) *Attorney, Agent, or Firm* — Fitzpatrick, Cella, Harper & Scinto

(57) ABSTRACT

A manufacturing method of a cartridge including an information storing element includes: a step of removing a first information storing element holding unit holding a first information storing element, from a frame including a positioning portion for positioning the first information storing element holding unit while leaving at least a part of the positioning portion, and of positioning a second information storing element holding unit including a second information storing element to a remaining portion of the positioning portion; and a step of connecting the second information storing element holding unit and the frame at the remaining portion.

17 Claims, 13 Drawing Sheets

(a)

(b)

(a)

(b)

(c)

(a)

(b)

(c)

(a)

(b)

(a)

(b)

(c)

(a)

(b)

(a)

(b)

MANUFACTURING METHOD OF CARTRIDGE INCLUDING INFORMATION STORING ELEMENT, INFORMATION STORING ELEMENT EXCHANGING METHOD OF THE CARTRIDGE, THE CARTRIDGE AND IMAGE FORMING APPARATUS

FIELD OF THE INVENTION AND RELATED ART

The present invention relates to a manufacturing method of a cartridge including an information storing element, an information storing element exchanging method of the cartridge, the cartridge and an image forming apparatus, and is suitable for an electrophotographic image forming apparatus. The electrophotographic image forming apparatus forms an image on a recording material (recording medium) by using an electrophotographic image forming process. Examples of the image forming apparatus include a printer (a laser beam printer, an LED printer or the like), a copying machine, a facsimile machine, a word processor and a multi-function machine (or printer) of these machines.

In the image forming apparatus such as the printer using the electrophotographic process, a photosensitive drum as an image bearing member is electrically charged uniformly, and then is subjected to selective exposure to light to form a latent image. Then, the latent image is visualized with a toner which is a developer, and a resultant toner image is transferred onto the recording material and then is fixed on the recording material under application of heat and pressure, so that image recording is carried out.

Such an image forming apparatus requires a toner supplying operation and maintenance of various process means. As a means for facilitating the toner supplying operation and the maintenance, a cartridge obtained by assembling these process means into a unit (cartridge) has been put into practical use. That is, a cartridge obtained by assembling, in a frame, a photosensitive drum, a charging means, a developing means, a cleaning means, the toner and the like into a unit.

According to this cartridge type, the maintenance of the image forming apparatus can be performed by a user himself (herself), so that it was possible to considerably improve operativity. Therefore, the cartridge type is widely used in the image forming apparatus.

It has been known that an information storing element for storing various pieces of service information and process information is mounted on the cartridge (Japanese Laid-Open Patent Application (JP-A) 2003-330335). In recent years, a product in which the information storing element for storing the various pieces of service information and process information is mounted on the cartridge is realized. A main assembly of the image forming apparatus uses memory information of this cartridge, thus further improving an image quality and the maintenance of the cartridge.

On the other hand, JP-A 2007-47397 discloses, as an information storing element exchanging method in the case where the information storing element is damaged in an assembling step or in the case where part defect occurs, a method in which an information storing element mounting table on which the information storing element is to be mounted is separated and then is exchanged (replaced) with a new one.

However, in a conventional constitution, in order to connect the information storing element mounting table gain, there was a need to provide a dedicated shape, for mounting (connecting) the information storing element on the information storing element, such as an adhesive injection hole or an adhesive flow path in the information storing element mounting table.

SUMMARY OF THE INVENTION

A principal object of the present invention is to provide a manufacturing method of a cartridge including an information storing element and an information storing element exchanging method, capable of mounting the information storing element with high accuracy without providing a dedicated shape for mounting (connecting) the information storing element on the cartridge.

Another object of the present invention is to provide the cartridge capable of mounting the information storing element with high accuracy without providing the dedicated shape for mounting (connecting) the information storing element on the cartridge, and to provide an image forming apparatus including the cartridge.

According to an aspect of the present invention, there is provided a manufacturing method of a cartridge including an information storing element, comprising: a step of removing a first information storing element holding unit holding a first information storing element, from a frame including a positioning portion for positioning the first information storing element holding unit while leaving at least a part of the positioning portion; a step of positioning a second information storing element holding unit including a second information storing element to a remaining portion of the positioning portion; and a step of connecting the second information storing element holding unit and the frame at the remaining portion.

According to another aspect of the present invention, there is provided a cartridge comprising: a frame from which a part of a positioning portion for positioning a first information storing element holding unit for holding a first information storing element is removed; and a second information storing element holding unit for holding a second information storing element at a remaining portion where the part of the positioning portion is removed.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings.

<First Embodiment>

(Image Forming Apparatus)

Figure 2:
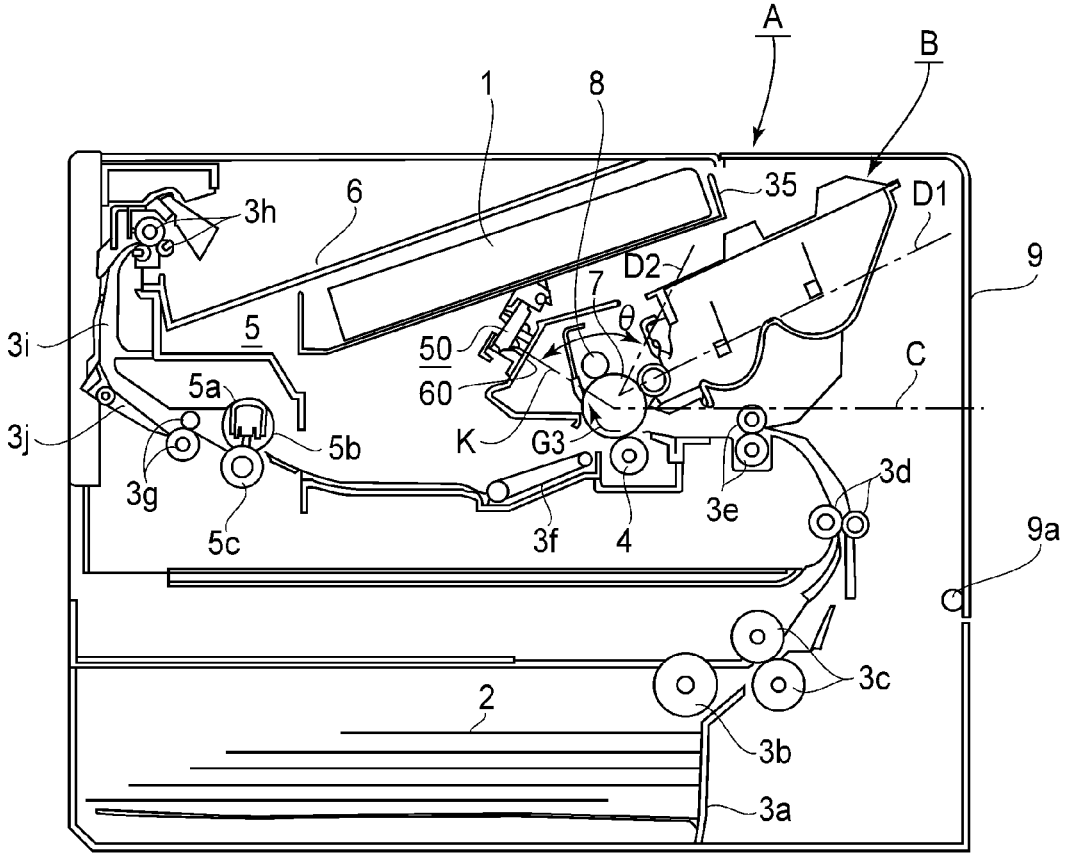
FIG. 2 is a sectional view showing an example of an image forming apparatus, of an electrophotographic type, to which the present invention is applicable.

With reference to FIG. 2, a general structure of an image forming apparatus, of an electrophotographic type, to which the present invention is applicable will be described. The image forming apparatus forms an image on a sheet material (recording material or medium) on the basis of an image signal inputted from an external host device, such as a personal computer, an image reader or a remote facsimile machine, into a controller portion (controller).

1) Cartridge for Image Formation

In a main assembly of the image forming apparatus, a cartridge is provided. The cartridge is defined as follows.

The cartridge is, e.g., a process cartridge or a developing cartridge and contributes to an image forming process for forming the image on the recording material in a state in which the cartridge is detachably mounted in an apparatus main assembly of the image forming apparatus. The apparatus main assembly of the image forming apparatus is an apparatus constituent portion obtained by removing the cartridge from a constitution of the image forming apparatus.

The process cartridge is prepared by integrally assembling a rotatable image bearing member on which a latent image is to be formed, and at least one of a charging means, a developing means, a cleaning means and the like as a process means, for image formation, acting on the image bearing member into a cartridge. Then, the process cartridge is detachably mounted into the apparatus main assembly. The image bearing member is an electrophotographic photosensitive member of an electrophotographic image forming type, an electrostatic recording dielectric member of an electrostatic recording image forming type, a magnetic recording (magnetic) member of a magnetic recording image forming type, and the like.

Therefore, the process cartridge includes a cartridge which is prepared by integrally assembling the image bearing member and the developing means as the image forming process means into a unit (cartridge) and which is detachably mountable to the apparatus main assembly. The process cartridge integrally includes the image bearing member and the developing means is referred to as a so-called integral type. Further, a process cartridge integrally including the image bearing member and the process means other than the developing means is referred to as a so-called function-separation type. That is, the developing means is provided in a developing unit other than the process cartridge, and a process cartridge for forming the image by being paired with the developing unit is referred to as the so-called function-separation type.

Further, the developing cartridge includes a developer carrying member (developing roller) for applying a developer to the image bearing member and accommodates the developer (toner) used for developing the latent image, by the developer carrying member, formed on the image bearing member, and is detachably mounted into the apparatus main assembly.

In the case of the developing cartridge, the image bearing member is mounted to the apparatus main assembly or a cartridge supporting member. Alternatively, the image bearing member is provided in the so-called function-separation type process cartridge. In this case, the process cartridge does not includes the developing means.

The cartridge includes the so-called integral type contact and the so-called function-separation type process cartridge. Further, the cartridge include the case where the so-called function-separation type process cartridge and the developing cartridge are used in a pair. Further, the cartridge includes the case where the image bearing member is fixedly mounted to the apparatus main assembly or the cartridge supporting member and the developing cartridge is used so as to be actable on the image bearing member and be detachably mountable the apparatus main assembly or the cartridge supporting member. Further, the cartridge includes a developer cartridge which accommodates the developer (toner) to be supplied to the process cartridge, the developing cartridge, or the like.

In the following, an example of the image forming apparatus in which the cartridge according to the present invention is to be detachably mounted will be specifically described. The image forming apparatus is an apparatus for forming the image on the recording material, such as recording paper, an OHP sheet or cloth, by using an electrophotographic image forming process. For example, the image forming apparatus includes an electrophotographic copying machine, an electrophotographic printer (an LED printer, a laser beam printer or the like), an electrophotographic facsimile machine and an electrophotographic word processor, but in this embodiment, particularly, the laser beam printer of the electrophotographic type will be described as an example.

An image forming apparatus (a laser beam printer in this embodiment) A includes a drum-shaped electrophotographic photosensitive member (hereinafter referred to as a photosensitive drum) 7. The photosensitive drum 7 is electrically charged by a charging roller 8 as a charging means. Then, the photosensitive drum 7 is irradiated with a laser beam (light), depending on image information, from an optical means 1 including a laser diode, a polygonal mirror, a lens, and a reflection mirror, so that a latent image depending on the image information is formed on the photosensitive drum 7. This latent image is developed by a developing device with a developer (hereinafter referred to as a toner) into a visible image, i.e., a toner image.

On the other hand, a synchronism with the formation of the toner image, a recording material 2 set in a sheet feeding cassette 3*a* is fed to a transfer by a pick-up roller 3*b*, and feeding roller pairs 3*c*, 3*d* and 3*e*. At the transfer position, a transfer roller 4 as a transfer means is provided, and by applying a voltage to the transfer roller 4, the toner image is transferred from the photosensitive drum 7 onto the recording material 2.

The recording material 2 on which the toner image is transferred is fed to a fixing means 5 via a feeding guide 3*f*. The fixing means 5 includes a driving roller 5*c* and a fixing roller 5*b* in which a heater 5*a* is incorporated, and applies heat and pressure to the recording material 2 personage therethrough, thus fixing the transferred toner image on the recording material 2. The recording material 2 is thereafter fed by discharging roller pairs 3*g* and 3*h* via a reversing path 3*i* to be discharged onto a discharge tray 6. This discharge tray 6 is provided at an upper surface of the image forming apparatus A. Incidentally, by actuating a swingable flapper 3*j*, it is also possible to discharge the recording material 2 without via the reversing path 3*i*.

Figure 3:
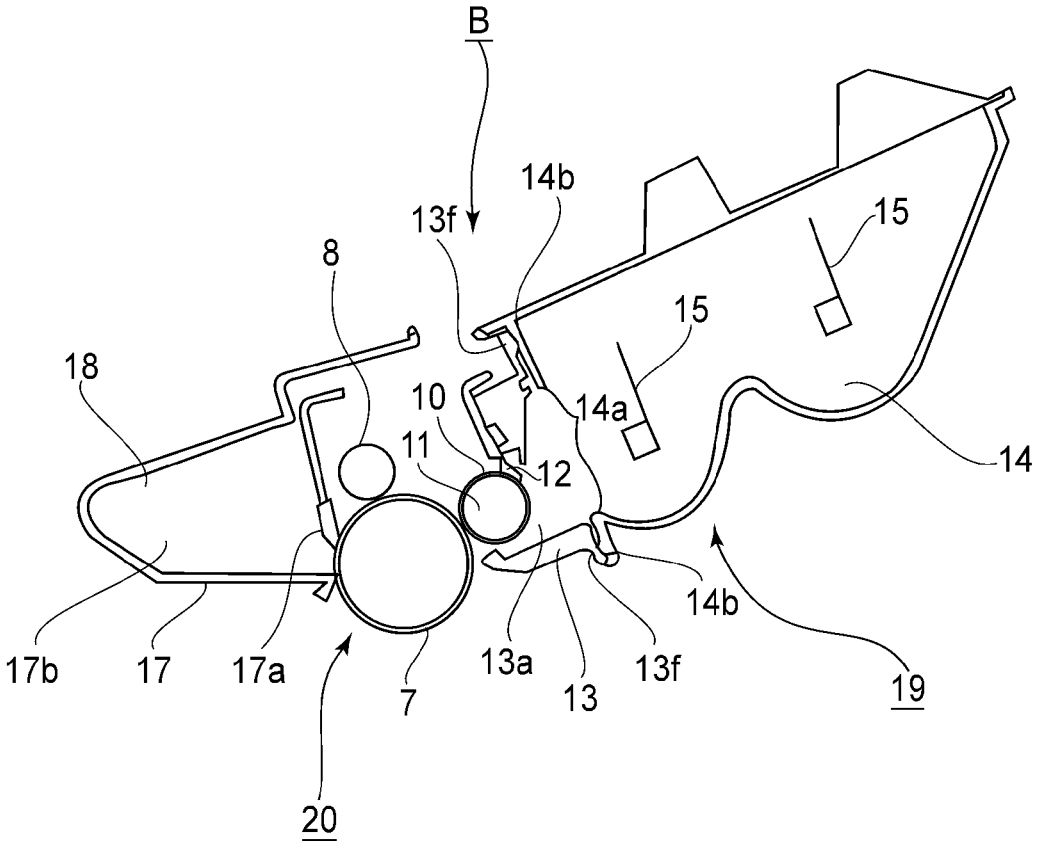
FIG. 3 is a sectional view showing an example of a cartridge to which the present invention is applicable.

On the other hand, as shown in FIG. 3, a cartridge B includes a photosensitive (member) unit 20 in which the photosensitive drum 7, the charging roller 8 and a cleaning means 17 such as an elastic cleaning blade 17*a* are integrally mounted to a drum frame 18. Further, the cartridge B includes a developing unit 19 constituted by a developing (device) frame 13 in which a toner accommodating container 14 accommodating the toner, a developing roller 10, a developing blade 12 and the like are held.

With respect to the cartridge B, the photosensitive drum 7 is rotated by an unshown driving source provided in the image forming apparatus A, and a surface thereof is uniformly charged by voltage application to the charging roller 8 as a charging means. Then, the surface of the photosensitive drum 7 is irradiated with the laser beam (light), depending on the image information, from the optical means 1, so that the latent image is formed. Then, the latent image is developed with the toner by the developing unit 19.

Further, the charging roller 8 is provided in contact with the photosensitive drum 7, and electrically charges the photosensitive drum 7. The charging roller 8 is rotated by the rotation of the photosensitive drum 7. The developing unit 19 supplies the toner to a developing region of the photosensitive drum 7, and develops the latent image formed on the photosensitive drum 7.

In the developing unit 19, the toner in the developer (toner) accommodating container 14 is sent to a developing chamber 13*a* by rotation of stirring members 15. With rotation of the developing roller 10 in which a magnet roller (stationary magnet) 11, a toner layer to which triboelectric charges are imparted by a developing blade 12 is formed on a surface of the developing roller 10.

Then, the toner is transferred onto the photosensitive drum 7 depending on the latent image, so that the toner image is formed, i.e., the latent image is visualized. The developing blade 12 not only regulates a toner amount on a peripheral surface of the developing roller 10 but also imparts the triboelectric charges to the toner.

The photosensitive drum 7 after the toner image is transferred onto the recording material 2 by the transfer roller 4 is subjected to a subsequent image forming process after a toner remaining on the photosensitive drum 7 is removed by the cleaning means 17. The cleaning means 17 scraped off a residual toner on the photosensitive drum 7 by the elastic cleaning blade 17*a* provided in contact with the photosensitive drum 7, and then collects the residual toner in a residual toner container 17*b*.

(Constitution of Information Storing Element and Information Storing Element Holding Unit and Mounting of Information Storing Element Holding Unit)

1) Constitution of First Information Storing Element Holding Unit 160 to be Mounted on Cartridge B Next, a constitution of a first information storing element holding unit 160 (FIG. 4) to be mounted on the cartridge B according to this embodiment will be described. In the following description, general structures of the cartridge B and the image forming apparatus A are similar to those described above as the example. Accordingly, in the following, a different constitution portion will be principally described, and members having similar constitutions and functions will be described by adding thereto the same reference numerals or symbols.

Figure 4:
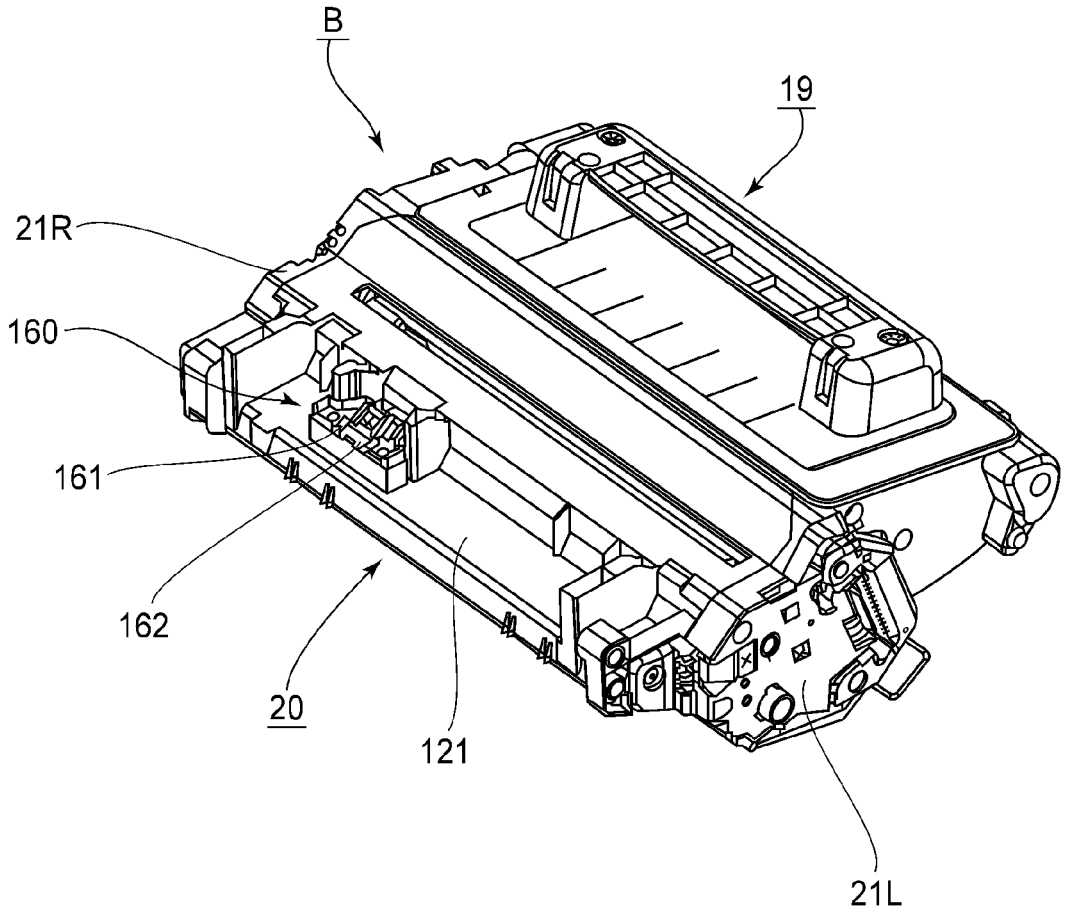
FIG. 4 is a perspective view of an outer appearance of the cartridge to which the present invention is applicable.

In FIG. 4, the photosensitive unit 20 and the developing unit 19 each constituting a part of the cartridge B are connected by side covers 21R and 21L provided in both sides. To a frame 121 of the photosensitive unit 20, the first information storing element holding unit 160 constituted by a first information storing element 161 and a first information storing element holding table 162 for holding the first information storing element 161 is connected (described later specifically).

Figure 5:
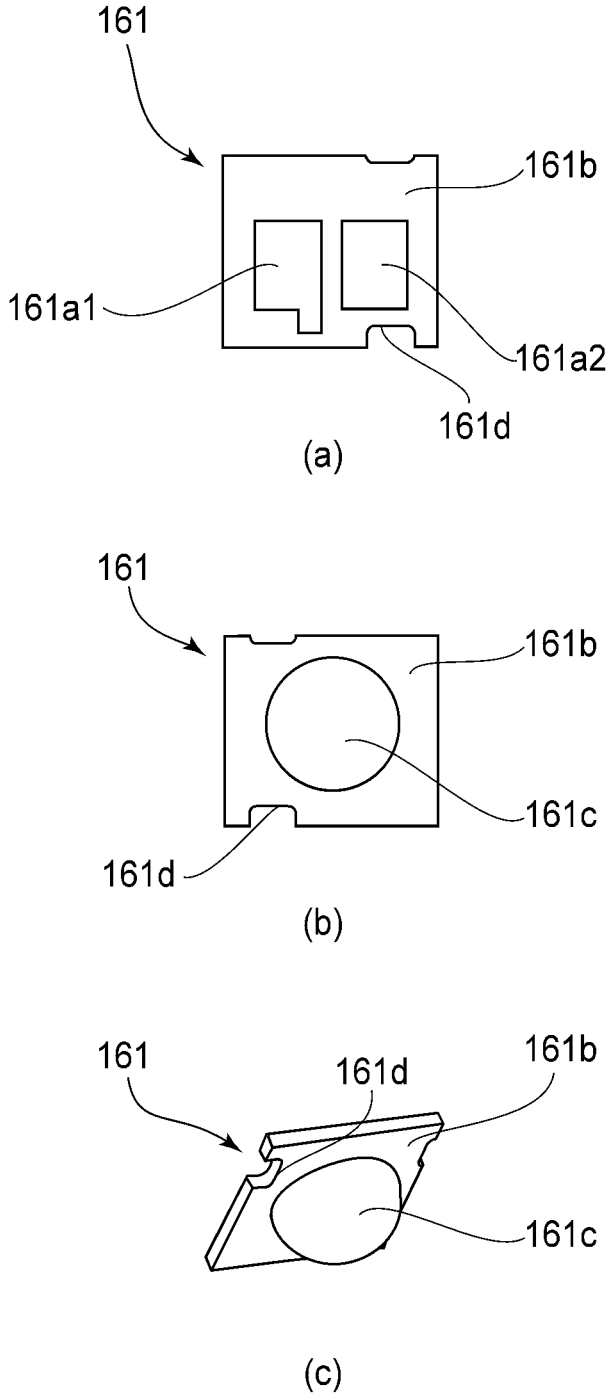
In FIG. 5, (a) to (c) are schematic views of an outer appearance of an information storing element to which the present invention is applicable.

In FIG. 5, (a) to (c) are schematic illustrations of the first information storing element 161, in which (a) is a front view of the first information storing element 161, (b) is a rear view of the first information storing element 161, and (c) is perspective rear view of the first information storing element 161. As shown in (a) to (c) of FIG. 5, the first information storing element 161 includes a substrate 161*b*, and information storing element contact portions 161*a*1 and 161*a*2 which are cartridge electrical contact members and which are provided on the substrate 161*b*. The information storing element contact portions 161*a*1 and 161*a*2 are used for being connected with contact members of a reading device 50 (FIG. 2) of the image forming apparatus A in order to read information into and write the information from a memory chip 161*c* described later.

On the back (rear) surface of the information storing element contact portions 161*a*1 and 161*a*2 shown in (a) of FIG. 5, the memory chip 161*c* as a storing means such as RAM or ROM. The memory chip 161*c* shown in FIG. 5 assumes an outer appearance in a covered state with a resin material or the like.

Into this memory chip 161*c*, necessary pieces of information (e.g., initial values and use status such as a lot number of the cartridge and a process condition, and characteristics of the image forming apparatus and the process means, and the like) are inputted. Further, in the memory chip 161*c*, it is also possible to write information as described in midstream when the cartridge B is used. Further, when the cartridge B is mounted in the image forming apparatus A and is used, the memory chip 161*c* transfers the information with the image forming apparatus A, and notifies a control circuit (not shown) for the image forming apparatus A of a state such as the use status of the cartridge B. As a result, it is possible to optimize the image forming operation and to display a state or the like of the cartridge so as to notify an operator of the displayed state.

2) Mounting of First Information Storing Element 161 on Information Storing Element Holding Unit 160

Figure 6:
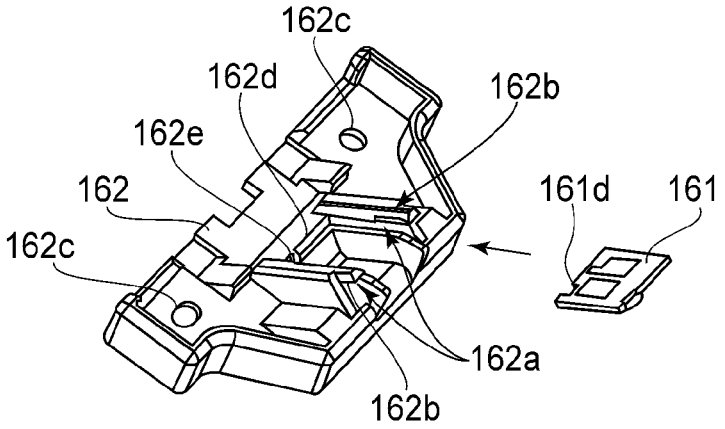
In FIG. 6, (a) to (c) are illustrations of a first information storing element holding unit in First Embodiment.
Figure 6:
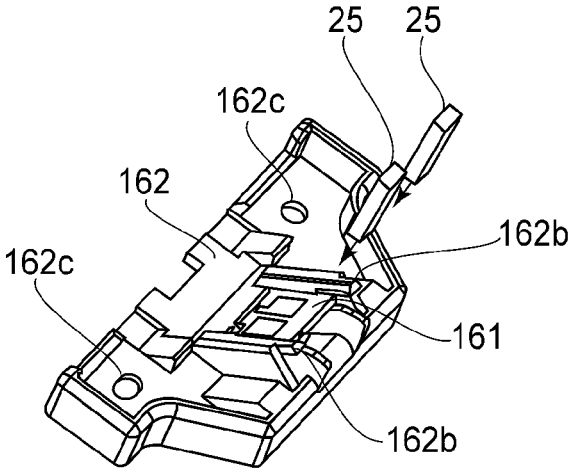
Figure 6:
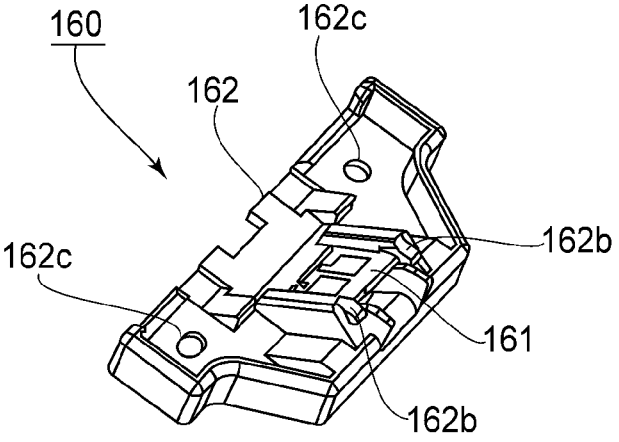

With reference to FIG. 6, a method in which the first information storing element 161 is mounted on the first information storing element holding table 162 to constitute the first information storing element holding unit 160 will be described. First, as shown in (a) of FIG. 6, the first information storing element 161 is inserted, in an arrow direction in the figure, into guiding grooves 162*a* provided in the first information storing element holding table 162, and is contacted to a limiting wall 162*d* provided in a rear side of the guiding groves 162*a*.

At this time, movement of the first information storing element 161 to a direction other than the direction along the guiding grooves 162*a* is limited by the limiting wall 162*d* and shapes of ribs or the like provided at a periphery of the limiting wall 162*d*. Further, the first information storing element holding table 162 is provided with a projection 162*e*, and on the other hand, the first information storing element 161 is provided with a cut-away portion 161*d*. These portions are constituted so as to be engaged with each other only in the case where the first information storing element 161 is assembled in a proper attitude, and prevent the first information storing element 161 from being assembled in an improper (erroneous) attitude.

Next, as shown in (b) of FIG. 6, holding projections 162*b* provided at two positions of the first information storing element holding table 162 are melted by being heated by heating members 25. Then, as shown in (c) of FIG. 6, a melted resin material of the holding projections 162*b* cover the first information storing element 161, thus holding the first information storing element 161 s as not to drop (fall) off from the first information storing element holding table 162. By the above-described procedure, the first information storing element holding unit 160 is constituted.

3) Mounting of First Information Storing Element Holding Unit 160 on Cartridge B A method in which the first information storing element holding unit 160 is mounted on the photosensitive unit 20 of the cartridge B will be described with reference to FIG. 7. As shown in (a) of FIG. 7, the frame 121 of the photosensitive unit 20 of the cartridge B is provided with a bearing surface 121*b* on which the first information storing element holding unit 160 is to be mounted and positioning projections 121*a* which are positioning portions of the first information storing element holding unit 160. The positioning projections 121*a* have a cylindrical shape or a circular truncated cone shape.

Figure 7:
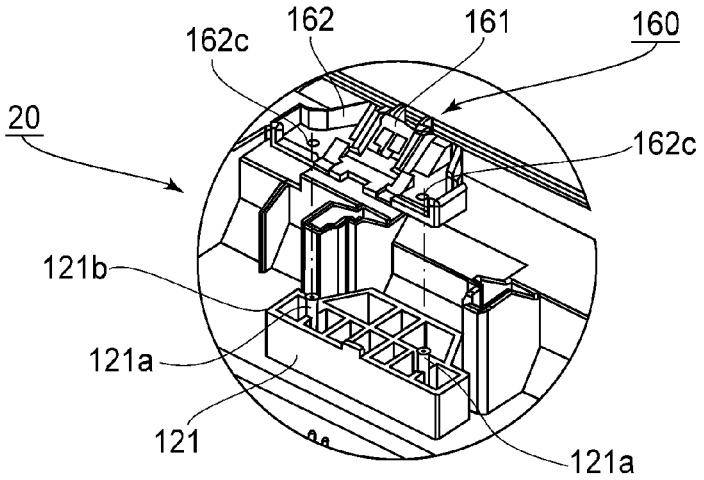
In FIG. 7, (a) to (c) are illustrations of mounting of the first information storing element holding unit in First Embodiment.
Figure 7:
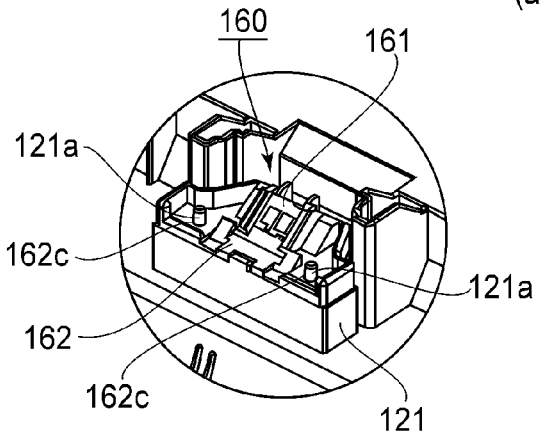
Figure 7:
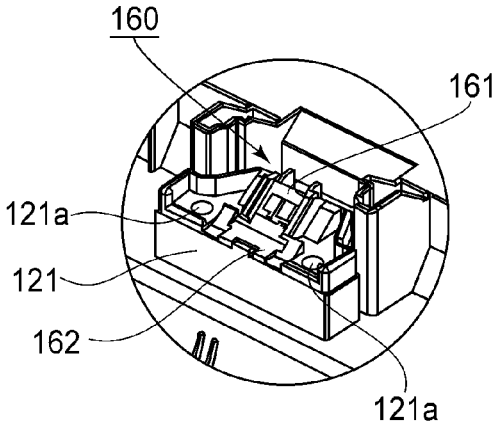

First, as shown in (a) and (b) of FIG. 7, the first information storing element holding unit 160 is mounted on the bearing surface 121*b* by engaging positioning holes 162*c* of the first information storing element holding table 162 with the positioning projections 121*a* provided on the frame 121 of the photosensitive unit 20. Then, as shown in (c) of FIG. 7, the positioning projections 121*a* are heated and melted so that a melted resin covers the positioning holes 162*c*, with the result that the first information storing element holding unit 160 is connected to the frame 121. By the procedure described above, the first information storing element holding unit 160 is mounted on the photosensitive unit 20 of the cartridge B.

A manufacturing method of the cartridge including the information storing element and an information storing element exchanging method of the cartridge in this embodiment will be described below.

(Exchange of First Information Storing Element Holding Unit 160)

In a step of assembling the cartridge, in the following cases, exchanges of the first information storing element holding unit 160 is needed. The case where the information storing element contact portions 161*a*1 and 161*a*2 of the first information storing element 161 are damaged or contaminated with a foreign matter, the case of a defective product for which information cannot be read and written in an inspection step, the case where the cartridge B used is recycled, and the like case exist.

Figure 8:
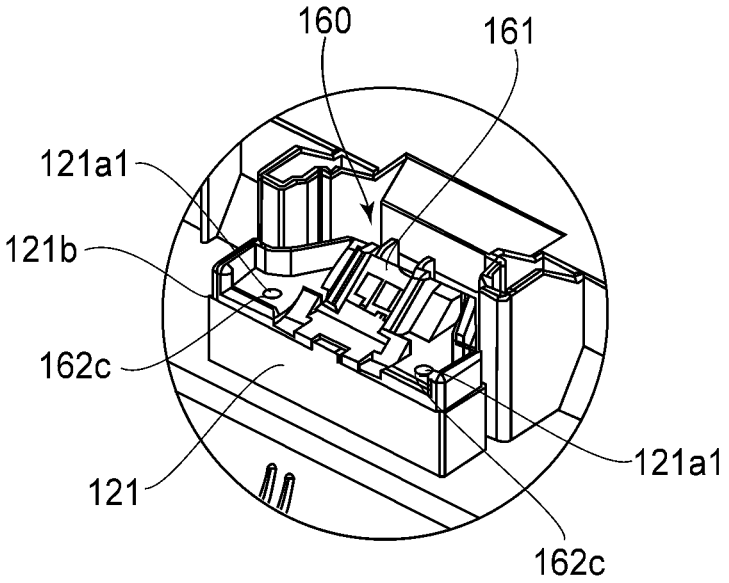
In FIG. 8, (a) and (b) are illustrations of dismounting of the first information storing element holding unit in First Embodiment.
Figure 8:
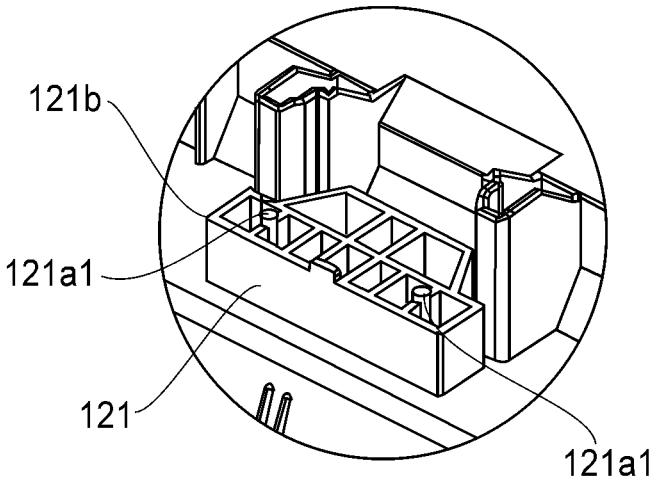

In the following, a method of exchanging (replacing) the first information storing element 161 with a second information storing element 171 with reference to FIGS. 1, 8 and 9. First, as shown in (a) of FIG. 8, the melted portions of the positioning projections 121*a* covering the positioning holes 162*c* of the first information storing element holding table 162 is removed. The frame 121 is formed of a material (e.g., a resin material such as high-impact polystyrene) from which a part of the positioning projections 121*a* can be removed.

As an example of a tool usable in this removing step, a cutting tool such as a cutter, a stylet, a nipper or a drill is used. As another example of the removing step, it is also possible to use a method in which the melted portions of the positioning projections 121*a* are broken and removed by inserting a plate-like tool into between the first information storing element holding unit 160 and the bearing surface 121*b* and then by peeling off the information storing element holding unit 160.

In either method described above, in order to use a remaining portion as a portion for mounting a second information storing element holding unit 170 described later, the positioning projections 121*a* are removed while partly leaving portions thereof as remaining portions 121*a*1 ((b) of FIG. 8). Further, it is desirable that broken pieces or the like, of the resin material, generated in this removing step are removed by providing a cleaning step.

Figure 1:
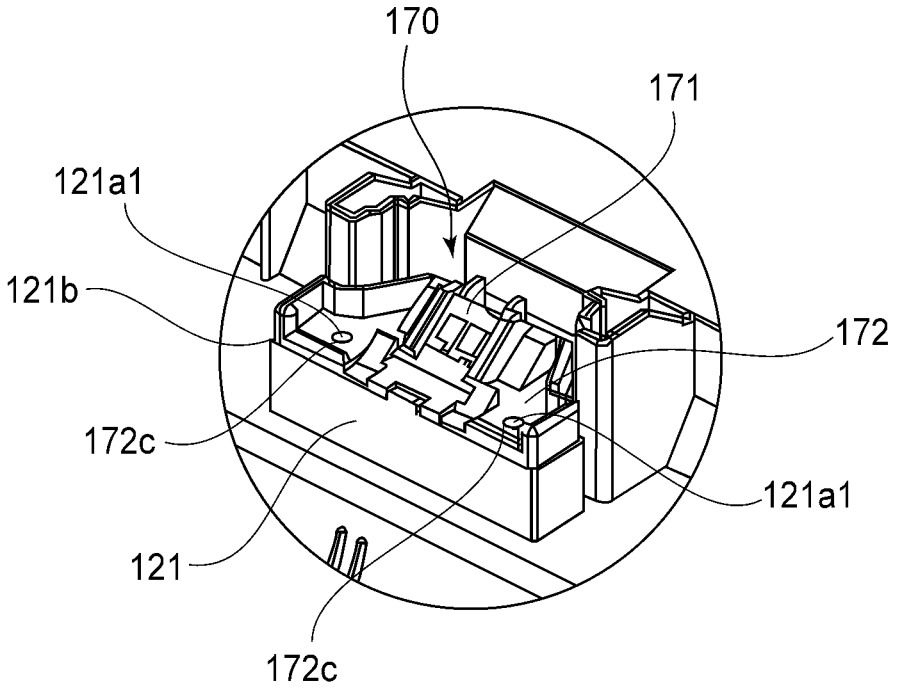
In FIG. 1, (a) and (b) are illustrations of a re-connecting method of a second information storing element holding unit in First Embodiment.
Figure 1:
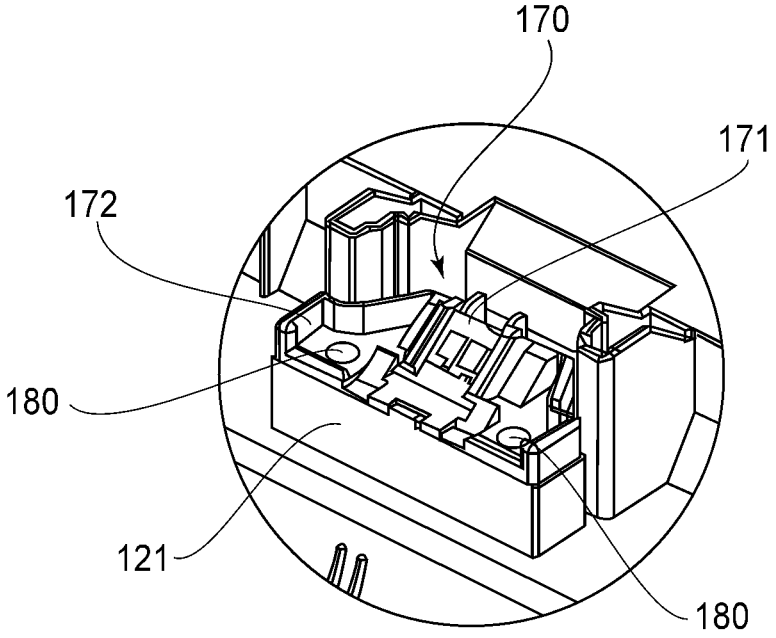

On the other hand, separately from this operation, as shown in FIG. 1, the second information storing element holding unit 170 constituted by a new second information storing element 171 and a second information storing element holding table 172 is prepared in advance. A constitution of the second information storing element 171 is the same as the constitution of the first information storing element 161. Further, a constituting method of the second information storing element holding unit 170 is the same as the constituting method of the first information storing element holding unit 160. Therefore, description of these will be omitted.

Next, a method of mounting the new second information storing element holding unit 170 on the frame 121 of the photosensitive unit 20 will be described. First, as shown in (a) of FIG. 1, the second information storing element holding unit 170 is mounted on the bearing surface 121*b* of the frame 121. At this time, positioning between the frame 121 and the second information storing element holding unit 170 is made by engaging positioning holes 172*c* of the second information storing element holding table 172 with the remaining portions 121*a*1 of the frame 121.

Then, with respect to connection after the positioning, as shown in (b) of FIG. 1, the second information storing element holding unit 170 and the frame 121 are connected to each other by applying and hardening an adhesive 180 so as to cover the positioning holes 172*c* and the remaining portions 121*a*1. As an example of the adhesive 180, a hot-melt adhesive, an epoxy adhesive or the like is used.

The connecting method of the second information storing element holding unit 170 and the frame 121 is not limited to the above-described method, but another method may also be used. For example, a method in which the remaining portions 121*a*1 are heat-melted integrally with the resin material at a periphery of the positioning holes 172*c* of the second information storing element holding table 172 and thus are connected again to the positioning holes 172*c* is used ((a) of FIG. 9).

Further, a method in which the remaining portions 121*a*1 are welded integrally with the resin material at the periphery of the positioning holes (grooves) 172*c* of the second information storing element holding table 172 by ultrasonic welding and thus are connected again to the positioning holes 172*c* is used. Further, a method in which the remaining portions 121*a*1 and the positioning holes 172*c* are connected by injecting a connecting solvent (terpene solvent (d-limonene or the like)) between the frame 121 and the second information storing element holding table 172 through the positioning holes 172*c* with an applying tool N is used ((b) of FIG. 9).

Figure 9:
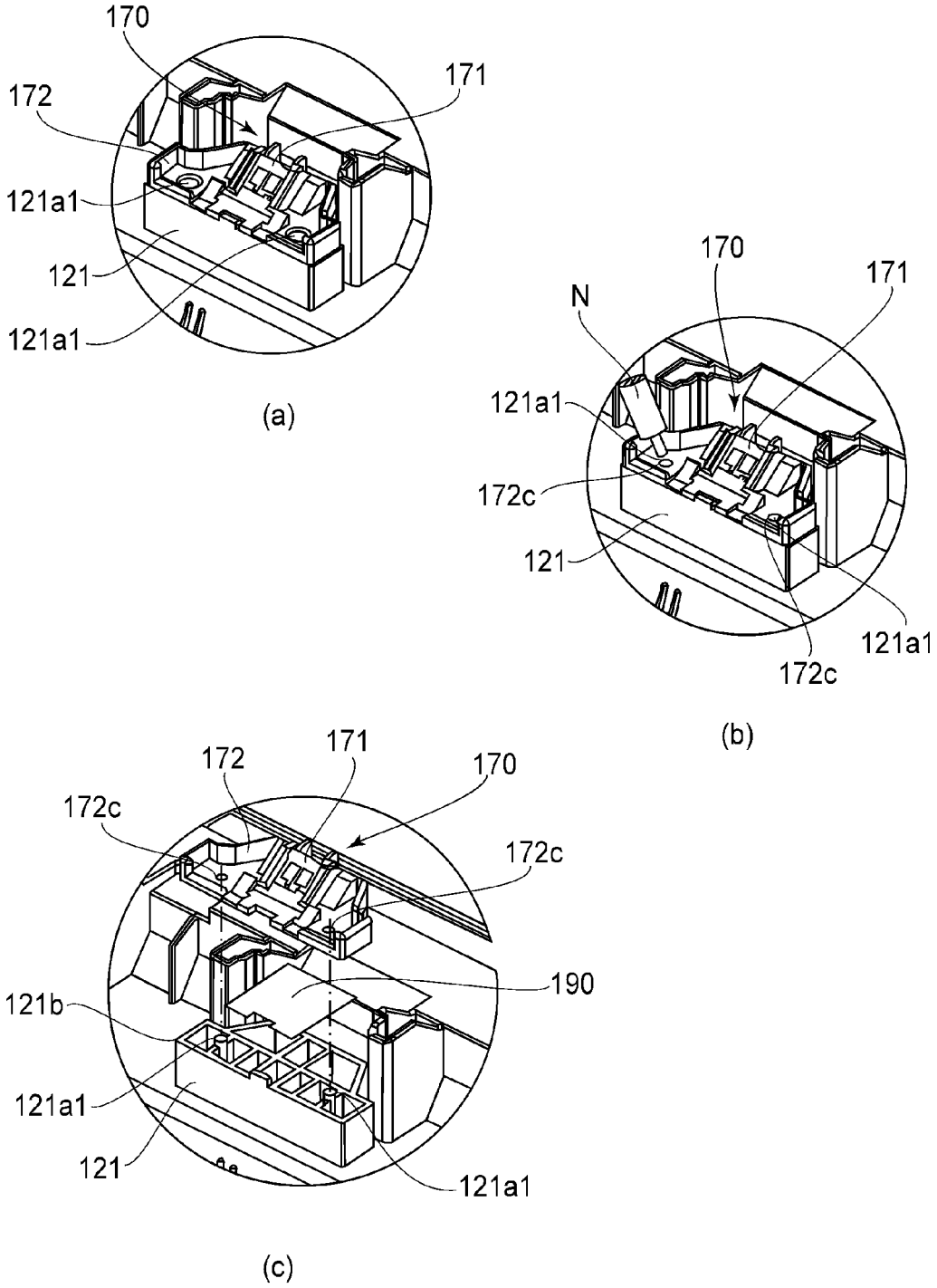
In FIG. 9, (a) to (c) are illustrations of another re-connecting method of the second information storing element holding unit in First Embodiment.

Further, it is also possible to use a method in which an adhesive member such as a double-side tape 190 is interposed between the second information storing element holding table 172 and the bearing surface 121*b* of the frame 121 ((c) of FIG. 9). In this case, it is also possible to apply the double-side tape 190 at the bearing surface 121*b* or a back surface of the second information storing element holding table 172 in advance. By the procedure described above, the new second information storing element holding unit 170 is connected to the photosensitive unit 20 of the cartridge B.

As a result, in the assembling step of the cartridge B, in the case where the information storing element contact portions 161*a*1 and 161*a*2 of the first information storing element 161 are damaged or contaminated with the foreign matter, the first information storing element 161 can be exchanged with the second information storing element 171. Similarly, in the case of the defective product for which the information cannot read and written in the inspection step and the case where the cartridge B used is recycled, and in the like case, the first information storing element 161 can be replaced with the second information storing element 171.

Further, with respect to the cartridge B in a state the cartridge B has already be used, the cartridge B can be placed again in a usable state by separately filling the toner therein or by exchanging the photosensitive drum 7, the charging roller 8, the developing roller 10, the developing blade 12, or the like, or various seal materials or the like, as desired.

According to the above-described methods, the positioning projections 121*a* of the frame 121 are partly left as the remaining portions 121*a*1, and can be used again for positioning the second information storing element holding unit 170. Therefore, the second information storing element holding unit 170 and the second information storing element 171 can be positioned relative to the photosensitive unit 20 with accuracy equal to the accuracy before the exchange.

Further, after the positioning, by connecting the remaining portions 121*a*1 and the positioning holes 172*c* by the method or the like in which the adhesive 180 is applied so as to cover the remaining portions 121*a*1 of the frame 121 and the positioning holes 172*c* of the second information storing element holding unit 170, it is possible to omit a dedicated shape in the frame 121 and the second information storing element holding unit 170 or the like.

As the described above, the manufacturing method of the cartridge including the information storing element and the information storing element exchanging method of the cartridge in this embodiment include the following steps.

That is, the former includes a step of dismounting the first information storing element holding unit, while leaving at least a part thereof from the frame including the positioning portion for positioning the first information storing element holding unit for holding the first information storing element. Further, the former includes a step of positioning the second information storing element holding unit including the second information storing element at the remaining portion of the positioning portion, and includes the step of connecting the second information storing element holding unit and the frame at the remaining portion.

Further, the latter includes a step of dismounting the first information storing element holding unit, while leaving at least a part thereof from the frame including the positioning portion for positioning the first information storing element holding unit for holding the first information storing element. Further, the latter includes a step of positioning the second information storing element holding unit including the second information storing element at the remaining portion of the positioning portion, and includes the step of connecting the second information storing element holding unit and the frame at the remaining portion.

As described above, according to this embodiment, a part of the positioning portion of the image information storing element holding unit is left, and the remaining portion can be used again as the positioning portion for positioning the second information storing element holding unit. Therefore, the second information storing element holding unit can be positioned relative to the cartridge with accuracy equal to the accuracy before the exchange. In addition, the dedicated shape used for connecting the second information storing element holding unit is not needed, and therefore it is possible to omit a shape used exclusively for the connection.

<Second Embodiment>

Second Embodiment of the present invention will be described. In this embodiment, positioning is carried out by engaging remaining portions with positioning grooves of the second information storing element holding table, and at the same time, by bringing abutting ribs into contact with an abutment surface. Also in this embodiment, the structures of the cartridge B and the image forming apparatus A are similar to those described above in First Embodiment. Accordingly, in this embodiment, a different constitution portion from First Embodiment will be principally described, and members having similar constitutions and functions to those in First Embodiment will be described by adding thereto the same reference numerals or symbols.

(Structure of Information Storing Element and Information Storing Element Holding Unit Mounting Constitution)

First a, method in which the first information storing element holding unit 260 in this embodiment is mounted on the cartridge B will be described with reference to FIG. 10. As shown in (a) of FIG. 10, the frame 121 of the photosensitive unit 20 of the cartridge B is provided with a bearing surface 221*b* on which the first information storing element holding unit 260 is to be mounted and projected positioning ribs (projections) 221*a* which are positioning portion of the first information storing element holding unit 260. Further, abutting ribs (projected portions) 221*c* are provided. Each of the positioning ribs is a projected portion which has a flat side surface and which extends so as to guide the information storing element holding unit in an insertion direction of a recessed portion of the information storing element holding unit.

Further, the first information storing element holding unit 260 is constituted by connecting a first information storing element 261 and a first information storing element holding table 262 similarly as in First Embodiment.

Figure 10:
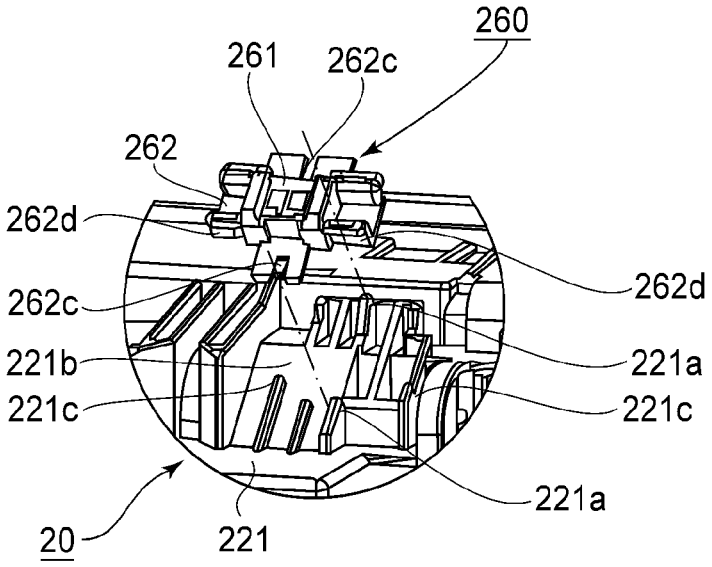
In FIG. 10, (a) to (c) are illustrations of mounting of a first information storing element holding unit in Second Embodiment.
Figure 10:
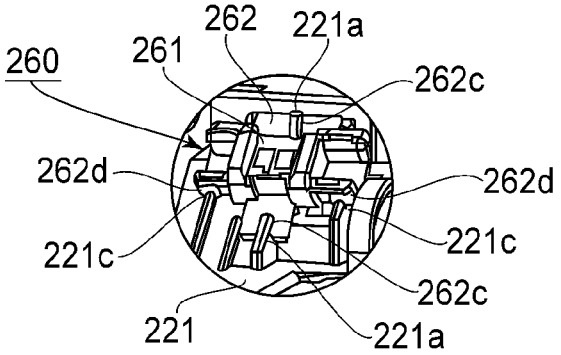
Figure 10:
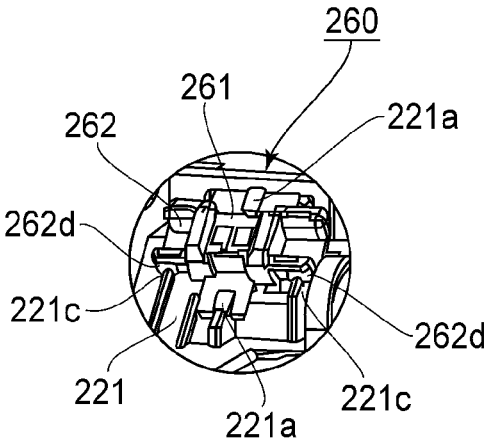

In order to mount the first information storing element holding unit 260 on the cartridge B, as shown in (a) and (b) of FIG. 10, first, the first information storing element holding unit 260 is mounted on the bearing surface 221*b*. At this time, positioning grooves 262*c* of the first information storing element holding table 262 and positioning ribs 221*a* provided on a frame 221 of the photosensitive unit 20 are engaged with each other.

At the same time, an abutment surface 262*d* of the first information storing element holding table 262 of the first information storing element holding unit 260 contacts the abutting ribs 221*c* of the frame 261. By the positioning ribs 221*a* and the abutting ribs 221*c*, the first information storing element holding unit 260 is prevented from moving in a parallel direction relative to the bearing surface 221*b*.

Then, as shown in (c) of FIG. 10, the positioning ribs 221*a* are heated and melted so that a melted resin covers the positioning grooves 262*c*, with the result that the first information storing element holding unit 260 is connected to the frame 221. By the procedure described above, the first information storing element holding unit 260 is mounted on the cartridge B.

(Exchange of First Information Storing Element Holding Unit)

Figure 11:
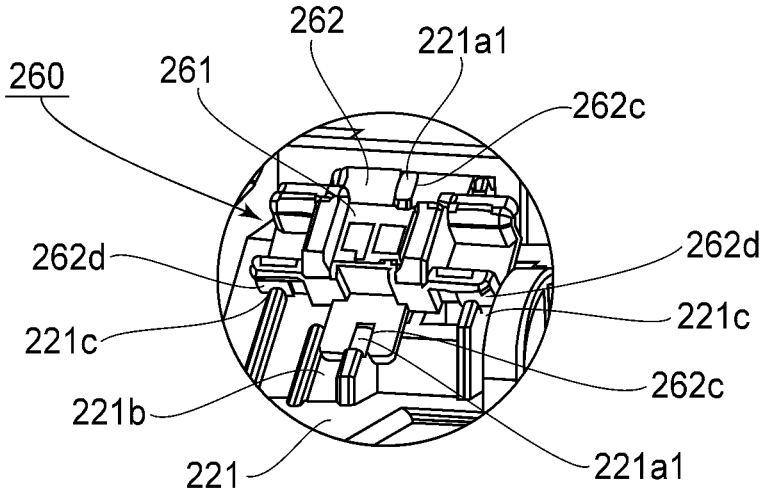
In FIG. 11, (a) and (b) are illustrations of dismounting of the first information storing element holding unit in Second Embodiment.
Figure 11:
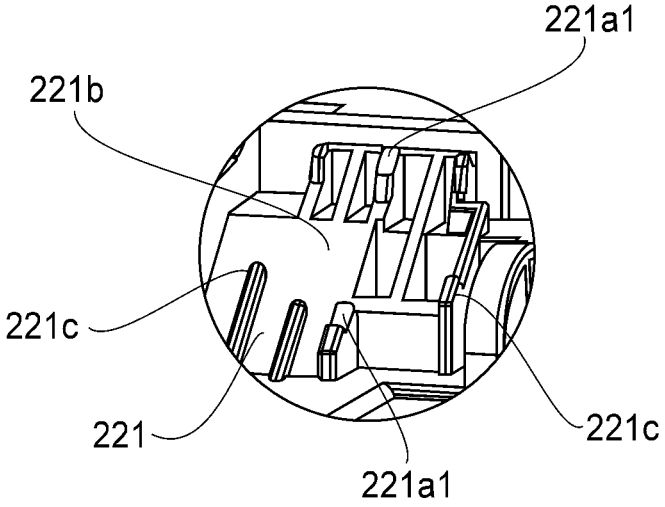

Next, a method of exchanging (replacing) the first information storing element 261 with a second information storing element 271 with reference to FIG. 11. First, as shown in (a) of FIG. 11, the melted portions of the positioning ribs 221*a* covering the positioning grooves 262*c* of the first information storing element holding table 262 is removed.

As an example of a tool usable in this removing step, a cutting tool such as a cutter, a stylet, a nipper or a drill is used similarly as in First Embodiment. As another example of the removing step, it is also possible to use a method in which the melted portions of the positioning ribs 221*a* are broken and removed by inserting a plate-like tool into between the first information storing element holding unit 260 and the bearing surface 221*b* and then by peeling off the information storing element holding unit 260.

In either method described above, in order to use a remaining portion as a portion for mounting a second information storing element holding unit 270 described later, the positioning ribs 221*a* are removed while partly leaving portions thereof as a remaining portion 221*a*1 ((b) of FIG. 11). Further, it is desirable that broken pieces or the like, of the resin material, generated in this removing step are removed by providing a cleaning step.

On the other hand, separately from this operation, the second information storing element holding unit 270 constituted by a new second information storing element 271 and a second information storing element holding table 272 is prepared in advance. A constitution of the second information storing element 271 is the same as the constitution of the first information storing element 261.

Next, a method of mounting the second information storing element holding unit 270 on the frame 121 of the photosensitive unit 20 will be described. First, as shown in (a) of FIG. 12, the second information storing element holding unit 270 is mounted on the bearing surface 221*b* of the frame 221. At this time, positioning between the frame 221 and the second information storing element holding unit 270 is made by engaging positioning grooves 272*c* of the second information storing element holding table 272 with the remaining portions 221*a*1 of the frame 221 and at the same time by bringing the abutting ribs 221*c* into contact with the abutment surface 272*d*.

Figure 12:
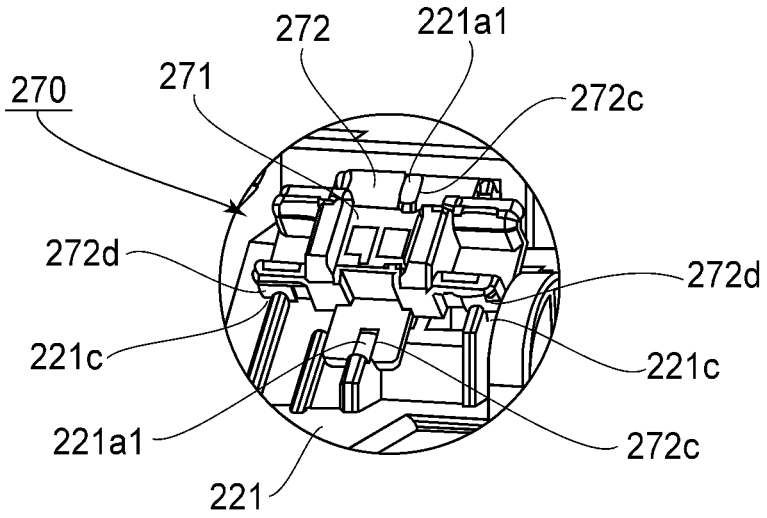
In FIG. 12, (a) and (b) are illustrations of a re-connecting method of a second information storing element holding unit in Second Embodiment.
Figure 12:
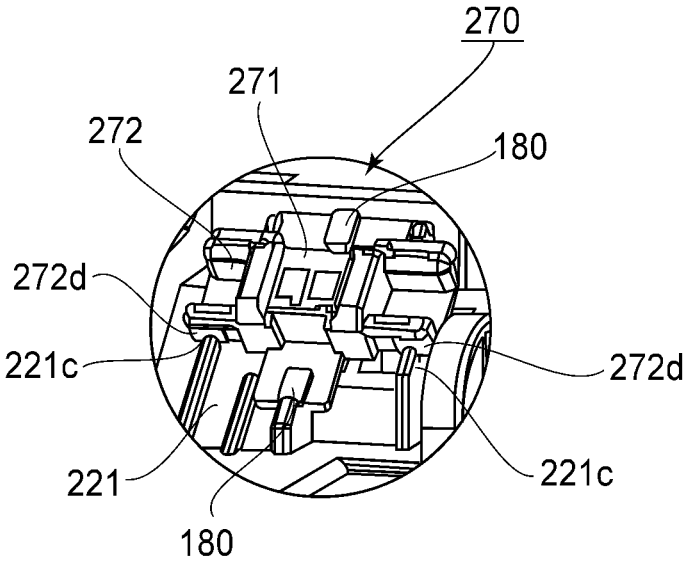

Then, as shown in (b) of FIG. 12, the second information storing element holding unit 270 and the frame 221 are connected to each other by applying and hardening an adhesive 180 so as to cover the positioning grooves 272*c* and the remaining portions 221*a*1. Similarly as in First Embodiment, as the connecting method of the second information storing element holding unit 270 and the frame 221, another method may also be used.

Figure 13:
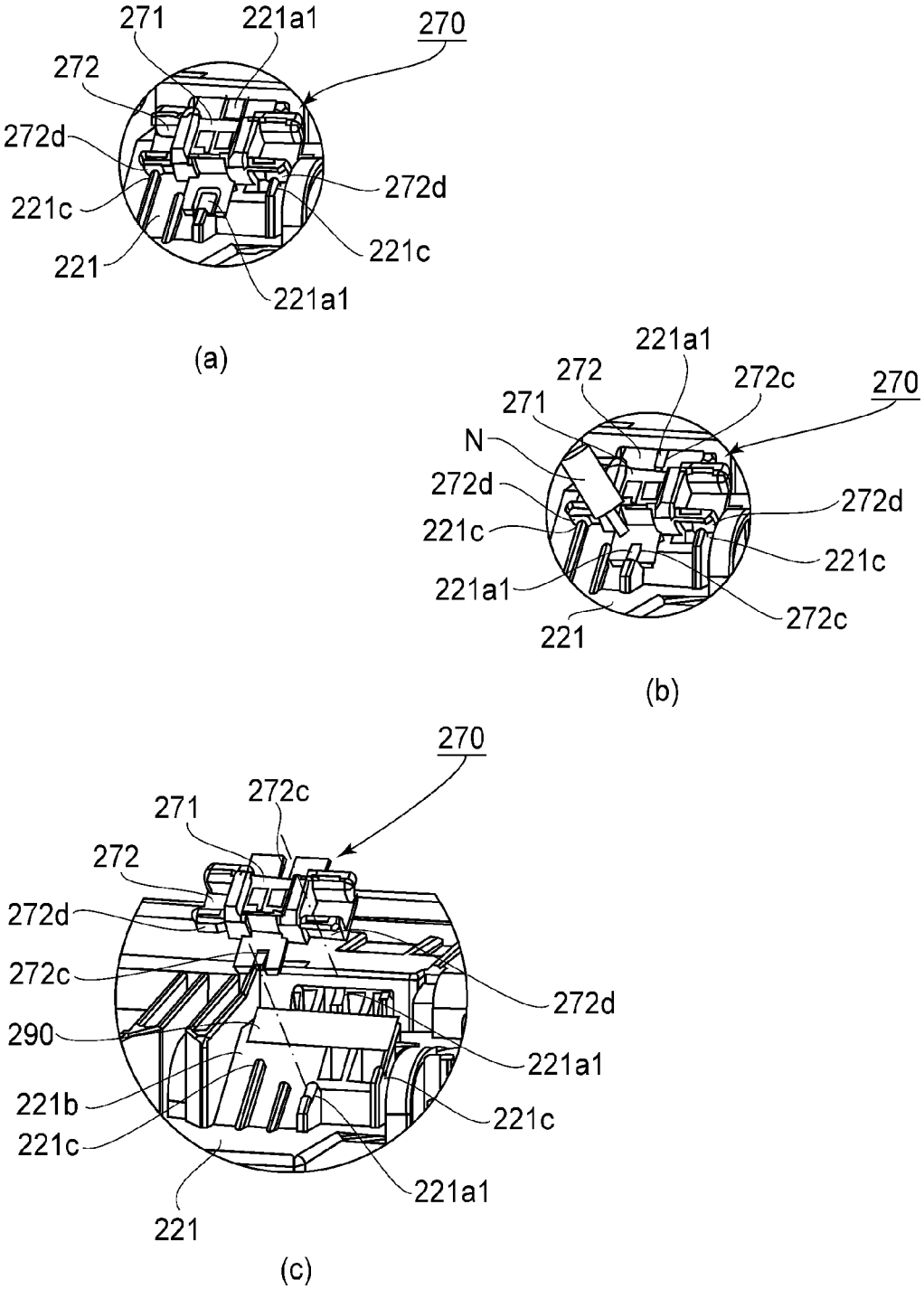
In FIG. 13, (a) to (c) are illustrations of another re-connecting method of the second information storing element holding unit in Second Embodiment.

For example, a method in which the remaining portions 221*a*1 are heat-melted integrally with the resin material at a periphery of the positioning grooves 272*c* of the second information storing element holding table 272 and thus are connected again to the positioning grooves 272*c* is used ((a) of FIG. 13). Further, a method in which the remaining portions 221*a*1 are welded integrally with the resin material at the periphery of the positioning grooves 272*c* of the second information storing element holding table 272 by ultrasonic welding and thus are connected again to the positioning grooves 272*c* is used. Further, a method in which the remaining portions 221*a*1 and the positioning grooves 272*c* are connected by injecting a connecting solvent (terpene solvent (d-limonene or the like)) between the frame 221 and the second information storing element holding table 272 through the positioning grooves 272*c* with an applying tool N is used ((b) of FIG. 13).

Further, it is also possible to employ a method in which an adhesive member such as a double-side tape 290 is interposed between the second information storing element holding table 272 and the bearing surface 221*b* ((c) of FIG. 13). In this case, it is also possible to apply the double-side tape 290 at the bearing surface 221*b* or a back surface of the second information storing element holding table 272 in advance. By the procedure described above, the new second information storing element holding unit 270 is connected to the photosensitive unit 20 of the cartridge B.

As a result, in the assembling step of the cartridge B, in the case where the information storing element contact portions of the first information storing element 261 are damaged or contaminated with the foreign matter, the first information storing element 261 can be exchanged with the second information storing element 271. Similarly, in the case of the defective product for which the information cannot read and written in the inspection step and the case where the cartridge B used is recycled, and in the like case, the first information storing element 261 can be replaced with the second information storing element 271.

Further, with respect to the cartridge B in a state the cartridge B has already be used, the cartridge B can be placed again in a usable state by separately filling the toner therein or by exchanging the photosensitive drum 7, the charging roller 8, the developing roller 10, the developing blade 12, or the like, or various seal materials or the like, as desired.

According to the above-described methods, the positioning ribs 221*a* of the frame 221 are partly left as the remaining portions 221*a*1, and can be used again for positioning the second information storing element holding unit 270. Therefore, the second information storing element holding unit 270 and the second information storing element 271 can be positioned relative to the photosensitive unit 20 with accuracy equal to the accuracy before the exchange.

Further, after the positioning, by connecting the remaining portions 221*a*1 and the positioning grooves 272*c* by the method or the like in which the adhesive 180 is applied so as to cover the remaining portions 221*a*1 of the frame 221 and the positioning grooves 272*c* of the second information storing element holding unit 270, it is possible to omit a dedicated shape in the frame 221 and the second information storing element holding unit 270 or the like.

As the described above, the manufacturing method of the cartridge including the information storing element and the information storing element exchanging method of the cartridge in this embodiment include the following steps.

According to the present invention, it is possible to mount the information storing element with high accuracy without providing the dedicated shape for mounting (connecting) the information storing element on the cartridge.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 247319/2013 filed Nov. 29, 2013, which is hereby incorporated by reference.

What is claimed is:

1. A manufacturing method of a cartridge including an information storing element, the manufacturing method comprising:

a step of removing a first information storing element holding unit holding a first information storing element, from a frame including a positioning portion for positioning the first information storing element holding unit while leaving at least a part of the positioning portion;

a step of positioning a second information storing element holding unit including a second information storing element to a remaining portion of the positioning portion; and a step of connecting the second information storing element holding unit and the frame at the remaining portion.

2. A manufacturing method according to claim 1, wherein the positioning portion has a cylindrical shape or a circular truncated cone shape.

3. A manufacturing method according to claim 1, wherein the positioning portion has a projected shape.

4. A manufacturing method according to claim 1, wherein the second information storing element holding unit and the frame are connected by an adhesive applied so as to cover the remaining portion and a part of the second information storing element holding unit.

5. A manufacturing method according to claim 1, wherein the second information storing element holding unit and the frame are connected by melting the remaining portion and a part of the second information storing element holding unit.

6. A manufacturing method according to claim 1, wherein the second information storing element holding unit and the frame are connected by a connecting solvent injected between the remaining portion and the second information storing element holding unit.

7. A manufacturing method according to claim 1, wherein the second information storing element holding unit and the frame are connected by a double side tape.

8. A manufacturing method according to claim 1, wherein the first information storing element holding unit includes the first information storing element and a first information storing element holding table for holding the first information storing element, and wherein the second information storing element holding unit includes the second information storing element and a second information storing element holding table for holding the second information storing element.

9. An image forming apparatus comprising:

a cartridge manufactured by a manufacturing method of a cartridge including an information storing element according to claim 1.

10. A cartridge comprising:

a frame from which a part of a positioning portion for positioning a first information storing element holding unit for holding a first information storing element is removed; and a second information storing element holding unit for holding a second information storing element at a remaining portion where the part of the positioning portion is removed.

11. A cartridge according to claim 10, wherein said second information storing element holding unit includes an information storing element holding table for holding the second information storing element.

12. A cartridge according to claim 11, wherein the second information storing element is provided at a front surface thereof with an electrical contact member to be connected with a contact member of a reading device of an image forming apparatus, and is provided at a back surface thereof with storing means.

13. A cartridge according to claim 10, further comprising a photosensitive unit and a developing unit, wherein said second information storing element holding unit is connected with a frame of said photosensitive unit.

14. An image forming apparatus comprising:

a cartridge according to claim 10 detachably mountable thereto.

15. An information storing element exchanging method of a cartridge, the information storing element exchanging method comprising:

a step of removing a first information storing element holding unit holding a first information storing element, from a frame including a positioning portion for positioning the first information storing element holding unit while leaving at least a part of the positioning portion;

a step of positioning a second information storing element holding unit including a second information storing element to a remaining portion of the positioning portion; and a step of connecting the second information storing element holding unit and the frame at the remaining portion.

16. An information storing element exchanging method according to claim 15, wherein the cartridge is detachably mountable to an image forming apparatus.

17. An information storing element exchanging method according to claim 15, wherein the first information storing element holding unit includes the first information storing element and a first information storing element holding table for holding the first information storing element, and wherein the second information storing element holding unit includes the second information storing element and a second information storing element holding table for holding the second information storing element.

* * * * *